United States Patent [19]

Didiergeorge

[11] Patent Number: 4,945,213

[45] Date of Patent: Jul. 31, 1990

[54] SYSTEM FOR ISSUING TICKETS

[75] Inventor: Pierre Didiergeorge, Besancon, France

[73] Assignee: Schlumberger Industries, S.A., Montrouge, France

[21] Appl. No.: 191,933

[22] Filed: May 9, 1988

[30] Foreign Application Priority Data

Nov. 27, 1986 [FR] France ..... 86 16540

[51] Int. Cl.[5] ..... G07B 3/00

[52] U.S. Cl. ..... 235/31 T; 235/98 R

[58] Field of Search ..... 235/31 T, 68 P, 98 R

[56] References Cited

U.S. PATENT DOCUMENTS 2,605,967 8/1952 Stone ..... 235/31 T X

*Primary Examiner*—Benjamin R. Fuller

*Attorney, Agent, or Firm*—Frishauf, Holtz, Goodman & Woodward

[57] ABSTRACT

The present invention relates to a system for issuing tickets and including means for delivering a warning signal when the remaining stock of paper falls below a given number of tickets. To do this, a strip (6) has a special mark on it together reference marks delimiting a length of strip corresponding to one ticket. A sensor (24) detects the passage of the special mark and loads a counter (40). Each time a reference mark goes past the sensor, the contents of the counter (40) is decremented. When a comparator (42) detects that the contents of the counter has reached a predetermined value, it delivers the warning signal.

3 Claims, 2 Drawing Sheets

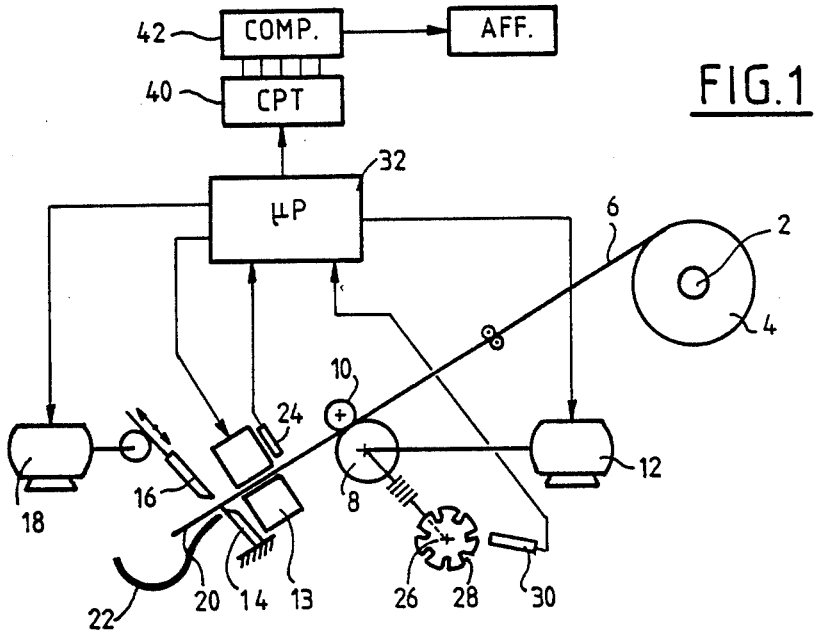
FIG.1
FIG.2
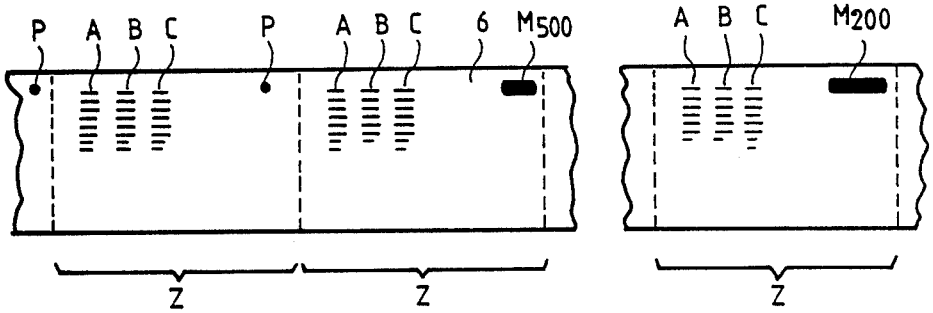

SYSTEM FOR ISSUING TICKETS

The present invention relates to a system for issuing tickets.

More precisely, the invention relates to a system for issuing tickets from a strip of paper mounted on a support and including means for generating a warning signal when the length of paper strip remaining on the support is equal to a length that corresponds to a predetermined number of tickets.

BACKGROUND OF THE INVENTION

There are numerous machines which include a system for issuing tickets having specific items printed thereon. By way of example, mention may be made of cash registers which deliver receipt tickets. Conventional cash registers are operated by a check-out clerk, and the clerk can therefore refill the machine with paper on which to issue tickets whenever it runs out.

Some ticket-issuing machines operate without anybody being in permanent attendance. They therefore receive periodic maintenance only. This is typically true of machines which issue tickets in receipt of payment for parking. Such machines are described, for example, in the present Assignee's patent application No. 870,554. When such ticket dispensers are in use, a driver who wishes to leave a vehicle parked pays money into the dispenser corresponding to the desired parking time. In exchange for this sum of money, the dispenser issues the driver with a ticket that bears at least the current date and the time at which authorized parking will expire, given the amount paid. The driver then places the ticket behind the windscreen of the parked vehicle so that parking inspectors can verify whether the appropriate parking fee has been paid in respect of any parked vehicle.

If the ticket dispensing machine runs out of paper, then the machine needs putting "out of service" and this can cause a loss of revenue to the organization selling parking.

For such machines, maintenance essentially comprises periodically collecting the money paid thereto. It is thus very important for the person responsible for collecting this money to be informed when the strip of paper is nearly used up so that a new roll can be inserted.

Further, it must also be understood that when the paper is suitable for thermal printing and is also preprinted, it is fairly expensive. It is thus particularly advantageous for the organization selling parking to put off replacing the rolls of paper to as late a moment as possible. However, the time at which the paper needs replacing depends both on the frequency with which maintenance personnel check the need to replace the paper and also on the frequency with which users cause the machine to issue tickets.

One proposal for solving this problem consists in mounting mechanical feeler systems in parking ticket dispensers in order to detect the thickness of the strip of paper remaining on the paper storage reel. The feeler keeps permanently in touch with the thickness of the reel and delivers an alarm signal when this thickness drops below a predetermined value. However, such a feeler is not very accurate in operation. Further it is difficult to adjust to give an alarm when the thickness of the paper remaining corresponds to the frequency with which the particular ticket-dispensing machine is used.

An aim of the present invention is to provide a ticket-issuing system having means for detecting when the supply of paper is running out in a manner which is reliable, which is easy to adjust, and which is readily adapted to a desired alarm threshold.

SUMMARY OF THE INVENTION

The present invention provides a ticket-issuing system including a strip of paper mounted on a support in order to dispense said tickets, said strip of paper including at least one mark on one of its main faces, the system including print means for printing a ticket on the strip, drive means for driving said strip to cause it pass through said print means, cutter means for cutting off a ticket from the remainder of the strip after it has been printed, detector means for detecting said mark to deliver a special detection signal in order to deduce information concerning the number of tickets remaining on the support, means for generating a reference signal representative of a predetermined number N of tickets, comparator means for comparing said predetermined number with the number of tickets remaining, and warning means for delivering a warning signal in response to said comparison.

It will be understood that by means of this special mark the processing system associated with the detector, e.g. an optical sensor, can easily generate a warning signal corresponding to a minimum supply of paper. In addition, this system requires no special initial adjustments of the machinery since the special mark is on the strip of paper itself.

In a first embodiment, the paper is pre-printed paper having end marks marking the ends of ticket-sized lengths of paper and the printing system includes means for detecting these end marks. In this case, the said special mark is likewise pre-printed and the detector for said special mark delivers a signal having characteristics suitable for distinguishing the special mark from a normal end mark.

In a second embodiment, the paper is stored on its support in the form of a reel. A radius is marked along one of the sides of the reel of paper thus giving a mark for each turn of the reel. The distance between two consecutive marks is a function of the radius of the turn in question which depends on the thickness of the paper, and in turn is a function of the length of paper remaining on the reel. By measuring the distances between pairs of consecutive marks, it is possible to detect the instant when the measured distance becomes equal to a desired quantity of ticket blanks remaining.

This second implementation of the invention requires more complicated data processing, but it has the advantage of being usable with paper which is not preprinted.

BRIEF DESCRIPTION OF THE DRAWINGS

Embodiments of the invention are described by way of example with reference to the accompanying drawings, in which:

FIG. 1 shows a first embodiment of a ticket-issuing system in accordance with the invention;

FIG. 2 shows a strip of paper usable with the FIG. 1 ticket-issuing system.

DETAILED DESCRIPTION OF PREFERRED EMBODIMENTS

Figure 3:
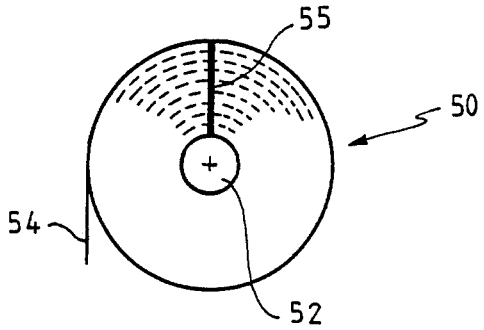
FIGS. 3 and 4 show a variant way of marking the reel of paper in order to detect the moment it needs changing.

Reference is made initially to FIG. 1 to describe a first embodiment of the ticket-issuing system. The system comprises a support 2 for a reel 4 of paper for use in making tickets. The strip of paper 6 is advanced, for example, by a drive wheel 8 and a backing wheel 10. The wheel 8 is rotated by a motor 12 so as to cause the strip of paper 6 to advance at known speed. Beyond the wheels 8 and 10, the strip of paper is guided to pass through a print head 13 which, in the example described, is a thermal print head. Thermal printers are well known and there is no need to describe one in greater detail herein. At the outlet from the print head 13 there is a paper cutter device comprising a fixed cutter blade 14 and a moving cutter blade 16 whose movements are controlled by a motor 18. After being cut from the remainder of the strip, the ticket 20 is picked up from a chute 22.

In the presently described example, the strip of paper 6 is of the pre-printed heat sensitive type. As can be seen more clearly in FIG. 2, the heat sensitive paper 6 comprises pre-printed matter A, B, and C and a reference point P in each portion Z of the strip corresponding to one ticket. The reference point P is disposed close to one of the edges of the strip of paper 6 and serves to index the pre-printed matter A, B, C relative to the matter printed on the ticket by means of the print head 13. In order to do this, and as shown in FIG. 1, the print system additionally includes an optical sensor 24 disposed upstream from the print head 12. The sensor 24 is disposed to detect the reference points P and to emit an indexing signal each time it detects a point P. Further, the information printed on the ticket is printed in columns of successive points which extend along a direction perpendicular to the direction of paper strip displacement. In order to obtain proper printing, it is necessary to synchronize the control of the printing points in the thermal print head which constitute a single print column with the displacement of the strip of paper 6. This synchronization is obtained by means of a wheel 26 whose periphery is provided with regularly spaced notches 28. The wheel 26 is rotated by the drive wheel 8 at a speed of rotation which is proportional to the speed of advance of the strip of paper. A second optical sensor 30 delivers a synchronization signal each time a notch goes past it.

The above-described system normally operates as follows:

The operations described below are under the control of a microprocessor 32 together with its associated circuits. When a ticket is to be printed, the microprocessor 32 switches on the motor 12. The strip of heat sensitive paper 6 thus advances at a known speed. When the detector 24 sees a reference point P go past, the microprocessor activates the thermal print head 13. The columns of points are successively printed in synchronization with the synchronization pulses delivered by the sensor 30. When all of the columns have been printed, the motor 12 continues to cause the strip of paper to advance by a predetermined length, and then the motor is stopped. The microprocessor 32 then causes the motor 18 associated with the moving cutter blade 16 to cut the printed ticket 20 from the remainder of the strip of paper, and the ticket 20 drops into the chute 22.

In a variant, the microprocessor may be programmed so that the paper cutting means 14 and 16 are switched on when the reference mark of the next ticket appears, and so that ticket printing begins only after the strip of paper has been driven a given length, which length is controlled by the pulses delivered by the sensor 30 in co-operation with the notched wheel 26.

The above-described operation is "ordinary" operation and does not monitor the supply of paper remaining on the reel 4, or more precisely the number of tickets that can still be printed. FIG. 2 shows a strip of pre-printed paper making this possible. In the zone Z corresponding to a ticket and situated, for example, 500 tickets before the end of the reel of paper, there is an additional pre-printed mark $M_{500}$ which is disposed so as to be visible to the detector 24 during that portion of strip travel which occurs between the last printing operation and the ticket 20 being cut off.

The mark $M_{500}$ may be pre-printed at the same time as the other items on the strip. While the strip of paper is being pre-printed, the pre-printing machine that forms the reel of pre-printed paper includes a counter which causes the $M_{500}$ mark to be printed after it has counted 500 tickets. This mark may be of any desired shape. All that matters is that the detector 24 should deliver an electrical signal in response thereto which is readily distinguishable from the signal which it delivers when an ordinary indexing point P goes past. For example, and as shown in FIG. 1, the mark $M_{500}$ may be constituted by an elongate line, alternatively it could be constituted by two consecutive points, etc...

The $M_{500}$ mark may also be added manually during pre-printing on the paper strip. More precisely, when the pre-printing and reel-forming machine arrives at the 500-th ticket, it stops and a mark is applied manually at an appropriate location. For example the mark may be printed on a small sticker which is applied to the strip.

Returning now to operation of the FIG. 1 device, it will be understood that when the mark $M_{500}$ passes the detector 24, the microprocessor 32 receives a special signal therefrom.

On receiving this signal, the microprocessor 32 increments a counter 40 to the value 500. Thereafter, each time an indexing point P is detected, the counter 40 is decremented by 1. Thus, the contents of the counter 40 is equal to the number of tickets remaining on the reel 4. The counter 40 is associated with a programmable digital comparator 42. The comparator 42 has a value N loaded therein which corresponds to the minimum number of remaining tickets, below which it is essential to change the reel of paper. When the counter 40 reaches the value N, the comparator 42 delivers a signal which causes an alarm to be displayed on a display device 44 in order to inform maintenance personal that the reel needs changing .

It may be advantageous to provide a second special mark $M_{200}$ which the sensor 24 can distinguish from the mark $M_{500}$ in order to mark the fact that beyond this ticket the length of paper remaining in the machine is good for printing only 200 more tickets. It may happen that the $M_{500}$ mark is not detected and therefore not loaded into the counter 40. When the $M_{200}$ mark is detected, the counter 40 is forced to the value 200. If the number N to which the comparator 42 is preset is greater than 200, then the warning signal is emitted immediately. Otherwise, the contents of the counter 40 is decremented by unity each time a ticket is issued until it counts down to the value N.

In the above-described solution, it is necessary to apply a special mark on the strip of paper in order to detect the approaching end of the strip. This solution is viable only if the reel of paper is printed. There follows a description of a second embodiment of the invention which is applicable to a strip of paper which is not pre-printed and which is given with reference to FIGS. 3 and 4.

Figure 4:
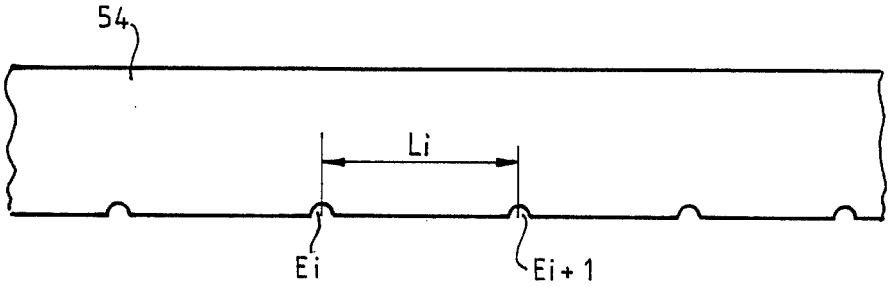

FIG. 3 shows a reel of paper 50 constituted by a hub 52 and a strip of paper 54 wound on the hub. Marking is obtained by marking a groove along a radius 55 of the side of the reel of paper. This type of marking creates one notch $E_i$ on the edge of the strip of paper for each turn of the reel. These notches $E_i$, $E_{i+1}$ are detectable by the optical detector 24. It will be understood that the length $L_i$ of the strip of paper between two consecutive notches $E_i$ and $E_{i+1}$ depends on the position of the portion of the strip of paper under consideration on the reel. The nearer to the hub 52 of the reel, the shorter distance $L_i$. More precisely, if the length $L_n$ of the portion of strip separated by two consecutive notches and constituting the n-th turn of the reel counting from the hub of the reel, then the following equation applies:

$$L_n=2\pi(R_0+ne)$$

where $R_0$ is the outside radius of the hub and e is the thickness of the strip of paper.

If it is desired to locate the moment when there remains sufficient length of paper strip to print 500 tickets, for example, it will be understood that the number of the turn on the reel corresponding to the end of the corresponding length of paper strip can readily be determined. Let this turn be the $n_1$-th turn. This turn corresponds to a length between two consecutive notches $L_1$ given by the equation:

$$L_1=2\pi(R_0=n_1e).$$

In order to detect when there is no more than 500 tickets' worth of paper left on the reel, all that needs to be done is to measure the lengths $L_i$ separating pairs of consecutive notches with accuracy. When $L_i$ is equal to $L_1$, then the turn having the 500-th ticket blank from the end of the reel has been detected.

This measurement may be performed using the device shown in FIG. 1. The detector 24 delivers each time a notch $E_i$ goes past it. This initializes a counting stage in a counter. The counter is incremented by the pulses delivered by the sensor 30 associated with the notched wheel 26. The counter counts these pulses. Counting is interrupted when the optical detector 24 delivers the next pulse corresponding to the next notch $E_i$ going past. Since the wheel 24 is driven at a speed which is proportional to the running speed of the strip of paper, the contents of the counter is effectively representative of the distance between the two notches. In order to detect the moment when the distance becomes equal to $L_1$, the simplest method is the following: given that the relationship between two consecutive notches 28 on the wheel 26 and the corresponding length of paper is accurately known, e.g. 0.3 mm, it is easy to determine the number $P_1$ of pulses which the sensor 30 will deliver for a length of paper corresponding to the length $L_1$.

At the end of each counting cycle, the contents of the counter is compared with the number $P_1$. When this contents becomes equal to $P_1$, then it has been detected that the current turn being printed contains the 500-th ticket from the end of the reel.

The above-described variant embodiment requires the microprocessor 32 to be given information corresponding to the thickness e of the strip of paper. This may be awkward given possible dispersion in parameters from one reel of paper to another. In order to remedy this drawback, the microprocessor 32 may be programmed to perform the following calculation.

After the reel of paper has been loaded into the machine, the microprocessor uses the signals delivered by the sensors 24 and 30 to calculate the lengths between consecutive pairs of notches for two turns which are separated by a known number of turns m.

If these two lengths $l_2$ and $l_3$, then the following equations apply:

$$l_2 = 2\pi(R_0 + (m + n)e) \text{ and}$$

$$l_3 = 2\pi(R_0 + ne) \text{ whence}$$

$$e = (l_2 - l_3)/2\pi m$$

In order to increase calculation accuracy, the length $L_2$ between two notches which are separated by four consecutive notches is calculated, e.g. between notches $E_i$ and $E_{i+p}$, and then the length $L_3$ is calculated between notch $E_{i+p}$ and $E_{i+2p}$ with the value $L_2/p$ providing an average value for $l_2$ and $L_3/p$ providing an average value for $l_3$, and with m being equal to p.

This particular example gives:

$$e=(L_2-L_3)/2\pi p^2$$

It must also be underlined that in the first embodiment it is not essential for the marks $M_{500}$ and $M_{200}$ to be optical marks. They could be magnetic marks, in which case the sensor 24 would need to a magnetic sensor.

The above-described system is particularly well adapted to the problem faced. It can be adjusted to give the warning signal when the number of tickets remaining is equal to a number desired by the organization responsible for machine management. Since the counter that is used for generating the warning signal is initialized when a special mark is detected, the system is relatively insensitive to actions that may have been performed on the machine, and in particular, it is insensitive to the electricity power supply being switched off prior to performing maintenance.

I claim:

1. A ticket-issuing system including a strip of paper having first and second main faces mounted on a support in order to dispense a plurality of tickets, said strip of paper including at least one mark on one of said main faces, the system including print means comprising an aperture for printing a ticket on the strip, drive means for driving said strip to cause said strip to pass through said aperture of said print means cutter means for cutting off a part of the strip that has been printed from a remainder of the strip, said printed part of the strip cut corresponding to a ticket, detector means for detecting said mark to deliver a special detection signal in order to deduce information concerning a number of tickets remaining on the strip, means for generating a reference signal representative of a predetermined number of tickets, comparator means for comparing said predetermined number of tickets with the number of tickets remaining, and warning means for delivering a warning signal in response to said comparison.

2. A ticket-issuing system according to claim 1, wherein said strip of paper is preprinted and includes a preprinted reference mark on each portion of the strip corresponding to one ticket, said at least one mark being likewise preprinted and corresponding to the number of tickets remaining on the strip, said detector means being suitable for delivering a first signal when said detector means detect said at least one mark, and a second signal each time said detector means detect one of said reference marks going past, memory means, means for loading said number of tickets remaining into said memory means when said first signal is emitted and means for decrementing said number of tickets remaining memorized in said memory means by one each time a second signal is emitted, and means for comparing said number of tickets remaining, decremented by one at each second signal, memorized in said memory means with the predetermined number of tickets remaining and for delivering said warning signal when said number of tickets remaining decremented by one memorized in said memory means becomes equal to said predetermined number of tickets.

3. A ticket-issuing system according to claim 1, wherein said strip of paper is stored on a reel and includes a plurality of marks, said marks being aligned along a radius on the side of the reel and each turn of said strip of paper including one of said marks, said means for deducing information about the number of tickets remaining comprising means for measuring the distance between two consecutive marks, and said comparator means including means for comparing said measurements with a reference value, said warning signal being delivered when said measurement becomes equal to said reference value.

* * * * *